US008984796B2

(12) United States Patent
Thomas et al.

(10) Patent No.: US 8,984,796 B2
(45) Date of Patent: Mar. 24, 2015

(54) LOCKABLE ADJUSTMENT MECHANISM

(71) Applicant: Tangent Theta Inc., Halifax, CA (US)

(72) Inventors: Christopher Ryan Thomas, Winchester, VA (US); Andreas Gerhard Schaefer, Hohenahr, DE (US)

(73) Assignee: Tangent Theta Inc., Halifax (CA)

( * ) Notice: Subject to any disclaimer, the term of this patent is extended or adjusted under 35 U.S.C. 154(b) by 0 days.

(21) Appl. No.: 13/656,515

(22) Filed: Oct. 19, 2012

(65) Prior Publication Data

US 2013/0160344 A1 Jun. 27, 2013

Related U.S. Application Data

(62) Division of application No. 12/684,585, filed on Jan. 8, 2010, now Pat. No. 8,312,667.

(60) Provisional application No. 61/144,662, filed on Jan. 14, 2009.

(51) Int. Cl.

| | |
|---|---|
| ***F41G 1/38*** | (2006.01) |
| ***F41G 1/28*** | (2006.01) |
| ***F41G 11/00*** | (2006.01) |
| ***F41G 1/18*** | (2006.01) |

(52) U.S. Cl.

CPC ..... *F41G 1/28* (2013.01); *F41G 11/001* (2013.01); *F41G 1/18* (2013.01)

USPC ..... 42/122; 42/119

(58) Field of Classification Search

CPC ..... F41G 1/16; F41G 1/18; F41G 1/20; F41G 1/22; F41G 1/24; F41G 1/26; F41G 1/28; F41G 1/38; F41G 1/387

USPC ..... 42/119, 122–139, 115; 359/425–429, 359/399; 33/298

See application file for complete search history.

(56) References Cited

U.S. PATENT DOCUMENTS

| | | | | |
|---|---|---|---|---|
| 3,990,155 | A * | 11/1976 | Akin et al. | 42/122 |
| 4,038,757 | A * | 8/1977 | Hicks et al. | 42/122 |
| 4,247,161 | A | 1/1981 | Unertl, Jr. | |
| 4,373,269 | A * | 2/1983 | Doliber et al. | 42/122 |
| 4,643,542 | A | 2/1987 | Gibson | |
| 6,279,259 | B1 | 8/2001 | Otteman | |
| 6,519,890 | B1 | 2/2003 | Otteman | |
| 6,643,970 | B2 | 11/2003 | Huber | |
| 6,691,447 | B1 | 2/2004 | Otteman | |
| 6,772,550 | B1 | 8/2004 | Leatherwood | |
| 7,415,791 | B2 | 8/2008 | Williams, III et al. | |
| 7,578,091 | B2 | 8/2009 | Klepp et al. | |

(Continued)

*Primary Examiner* — Jonathan C Weber
(74) *Attorney, Agent, or Firm* — Fish & Richardson P.C.

(57) ABSTRACT

A scope adjustment system includes a turret cap assembly, a saddle assembly, and a quick spanner assembly. The turret cap assembly includes a ring with a plurality of regularly spaced apart teeth residing circumferentially around the ring. The saddle assembly includes a transportation element in mechanical communication with a plunger. The saddle assembly includes a click element to engage the teeth of the ring. The quick spanner assembly includes a bolt that may be coupled to the transportation element, a cam lock hinged to the bolt, and a pressure plate residing between the bolt and the cam lock. The bolt can be screwed into the transportation element, and the cam lock can be set to apply a force on the pressure plate such that the transportation element engages the plunger. When engaged, the plunger is responsive to rotations of the turret cap to adjust, e.g., an aiming reticle.

19 Claims, 13 Drawing Sheets

View A-A

(56) References Cited

U.S. PATENT DOCUMENTS

| | | | | |
|---|---|---|---|---|
| 7,581,346 | B2 | 9/2009 | Klepp et al. | |
| 7,612,952 | B2 | 11/2009 | Schafer | |
| 7,626,760 | B2 | 12/2009 | Wu | |
| 7,640,830 | B2 | 1/2010 | Bonis | |
| 7,934,335 | B2 | 5/2011 | Halverson | |
| 7,937,879 | B2 | 5/2011 | Hamilton | |
| 7,958,665 | B2 | 6/2011 | Hamilton | |
| 7,997,163 | B2 | 8/2011 | Casas | |
| 8,006,429 | B2 | 8/2011 | Windauer | |
| 8,166,696 | B2 * | 5/2012 | Hamilton | 42/122 |
| 8,270,104 | B2 * | 9/2012 | Windauer | 359/821 |
| 8,397,420 | B2 * | 3/2013 | Hamilton | 42/122 |
| 8,449,131 | B2 * | 5/2013 | Tang et al. | 362/85 |
| 8,516,736 | B2 * | 8/2013 | Windauer | 42/122 |
| 2003/0140545 | A1 | 7/2003 | Huber | |
| 2007/0137089 | A1 | 6/2007 | William et al. | |
| 2007/0240356 | A1 | 10/2007 | Klepp et al. | |
| 2008/0066364 | A1 | 3/2008 | Klepp et al. | |
| 2008/0236018 | A1 | 10/2008 | Halverson | |
| 2008/0289239 | A1 | 11/2008 | Menges et al. | |
| 2009/0044660 | A1 * | 2/2009 | Bonis | 74/813 L |
| 2009/0241399 | A1 | 10/2009 | Hamilton | |
| 2010/0229451 | A1 | 9/2010 | Hamilton | |
| 2011/0061285 | A1 | 3/2011 | Hamilton | |
| 2011/0100152 | A1 * | 5/2011 | Huynh | 74/504 |
| 2011/0102918 | A1 * | 5/2011 | Windauer | 359/821 |
| 2012/0167444 | A1 * | 7/2012 | Adkins et al. | 42/135 |
| 2012/0195023 | A1 * | 8/2012 | Tang et al. | 362/85 |
| 2012/0266515 | A1 * | 10/2012 | Hamilton | 42/119 |

* cited by examiner

LOCKABLE ADJUSTMENT MECHANISM

RELATED APPLICATION

This application claims priority under 35 U.S.C. §121 U.S. Utility application Ser. No. 12/684,585, filed Jan. 8, 2010, which claims priority under 35 U.S.C. §119 to U.S. Provisional Application No. 61/144,662, filed Jan. 14, 2009, the entire disclosures of which are incorporated herein by reference.

TECHNICAL FIELD

This disclosure relates to scopes and lockable adjustment mechanisms for scopes.

BACKGROUND

Rifle scopes are typically equipped with at least one adjustment mechanism such that a shooter can accommodate for various conditions that can cause the point of impact of a fired bullet to vary compared to an originally set aiming mark, such as the ballistic properties of a bullet, environmental conditions (altitude, humidity, wind, etc.), and the distance to the target. Adjustment mechanisms may provide movement of the reticle on the image that is created by the objective system (e.g., first focal plane) or the objective and the erector system (e.g., second focal plane). Knowing or estimating the environmental conditions and other factors influencing the point of impact, the shooter can adjust the reticle position so that the expected point of impact will be at the aiming mark again.

SUMMARY

A scope adjustment mechanism may include a turret cap assembly, configured to rotate about an axis of rotation. The turret cap may include a first cylindrical region adjacent a second cylindrical region, the first cylindrical region having a first interior side with a first inner diameter, the second cylindrical region having a second interior side with a second inner diameter. The first inner diameter may be less than the second inner diameter, which together forms an interior lateral surface adjacent the second cylindrical region and an exterior lateral surface facing away from the second cylindrical region. The first and second inner diameters may be orthogonal to the axis of rotation. A ring residing on the second interior side of the cap may include a plurality of evenly spaced apart teeth residing circumferentially around the ring. The adjustment mechanism may also include a saddle assembly configured to couple with the turret cap assembly. The saddle assembly may have a saddle base defining a base annulus concentric with the axis of rotation. A transportation element may reside within the base annulus and may be configured to receive a bolt. The transportation element may also include a plunger mount adjacent the saddle base defining a plunger annulus concentric with the axis of rotation. A plunger element may reside in the plunger annulus and in mechanical communication with the transportation element. A click element may be mechanically fixed to the saddle base and be configured to engage the teeth of the ring. A quick spanner assembly may include a bolt configured to be received by the transportation element, a cam lock comprising an eccentric cam hinged to the bolt, and a pressure plate residing between the bolt and the cam lock. The eccentric cam may contact the pressure plate when locked. The interior lateral surface of the turret cap assembly may reside on the transportation element, removably coupling the turret cap assembly to the saddle assembly and contacting the click element with the ring.

A scope may include a tube, an objective system, an ocular system, and an erector system. The erector system may include an adjustment mechanism connected to the tube such that the adjustment mechanism provides movement of a reticle on an image that is created by the objective system, the adjustment mechanism comprising a saddle mechanism, a turret cap mechanism, and a quick release mechanism. The quick release mechanism may include a threaded bolt, a lever, and a pressure plate, the pressure plate residing between the threaded bolt and the lever, which may be hingedly attached to the bolt. The pressure plate may be adjacent to the turret cap mechanism and apply pressure to the turret cap mechanism when the quick release mechanism is in the locked position. The quick release mechanism may be connected to the saddle mechanism. The quick release mechanism may further include a cam lock with an eccentric cam and an axle that cam lock the turret cap assembly such that when the cam lock is in a locked position and the turret cap is rotated, a transportation piece that is part of the saddle mechanism affects the position of a reticle.

DETAILED DESCRIPTION

Figure 1:
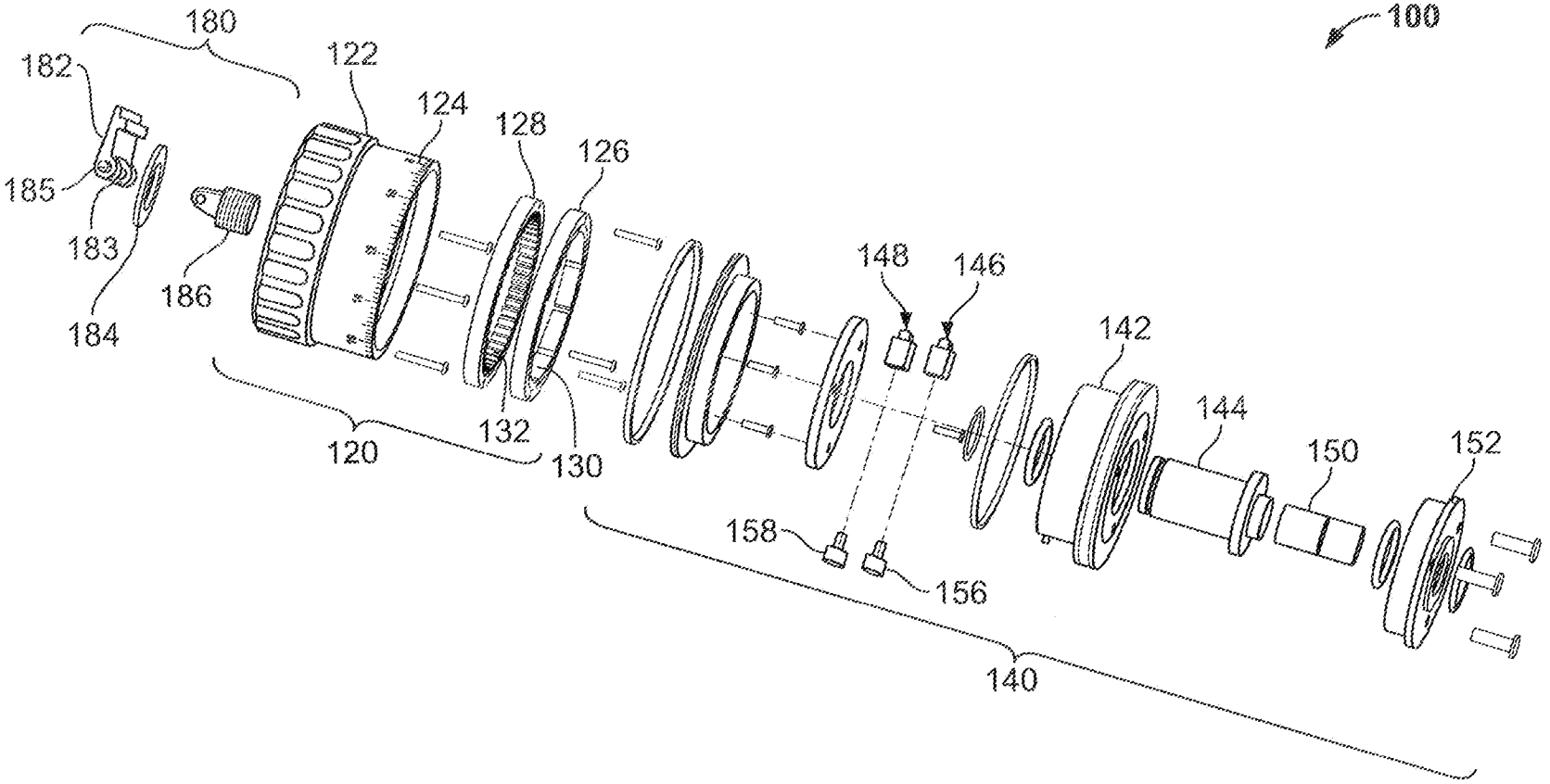
FIG. 1 is an exploded view of one embodiment of the adjustment mechanism of the present disclosure showing the constituent components.

At a high level, this disclosure describes a scope and scope adjustment mechanism. The scope may include a tube, an objective system, an ocular system, and an erector system wherein the erector system may further include an adjustment mechanism system rotatably connected to the tube such that the adjustment mechanism system provides movement of a reticle on an image that is created by the objective system, and wherein the adjustment mechanism system may include a saddle mechanism, a turret cap mechanism, and a quick release (or spanner) mechanism. The quick release mechanism may include a threaded bolt, a pin, a lever, and a pressure plate. In other words, the quick release mechanism may include a cam-lock with an eccentric cam and an axle that together cam lock the turret cap assembly such that when the cam lock is in a locked position and the turret cap is rotated, a transportation piece housed within the saddle assembly rotates to affect the position of a reticle or aiming mark. The quick release mechanism may be connected to the saddle mechanism. In addition, the quick release mechanism can be unlocked by an article acting as a lever, for example, a coin or the rim of a cartridge. Generally, the pressure plate is adjacent to the turret cap mechanism and applies pressure to the turret cap mechanism when the quick release mechanism is in the locked position.

The adjustment mechanism of the scope can further include a tactile and/or audible click mechanism wherein the tactile and/or audible click mechanism can include a first and a second plurality of click values corresponding to a predetermined shift in a position of a reticle of the scope; and wherein the first plurality of click values has a different tactile response and/or audible response than the second plurality of click values. Having at least a first and second click value may provide for high precision adjustments for short, medium, and long-range targets without the need to keep count of a large number of clicks. A third plurality of click values is also possible, which may add further convenience for precision adjustments at longer ranges (or shorter ranges, depending on the configuration). The click mechanism can further include a click ring having a first plurality of detents and a second plurality of detents, with the first and second pluralities of detents corresponding to different tactile responses and/or audible responses, and a click element that engages said detents. As an example, the click ring may have 120 total detents, made up of a combination of the first and second plurality of detents; as another example, the click ring may similarly have 240 detents. The detents can be grooves, ridges, or teeth. The scope can include two click rings wherein the first plurality of detents are on a different click ring from the second plurality of detents. Alternatively, the first and second plurality of detents can be on a single ring. For example, the first plurality of detents may reside above or below the second plurality of detents similar to the two-ring embodiment. As a further example, the first plurality of detents may be inline with the second plurality of detents, the first plurality possibly having a different form or structure from the second plurality of detents (for example, the first plurality of detents may be deeper grooves than the second plurality of detents).

The turret mechanism may house the click ring or click rings. The turret mechanism may include a turret housing, which may be generally cylindrical in shape and open on each end. One end of the turret may have a smaller diameter opening than the other end. The click rings may be arranged within the housing in the space defined by the inside of the turret, and may be concentric with the cylindrical axis of the turret. The scope can further include two click elements wherein each click element engages a different set of detents. The click element can comprise a detent ball or generally wedge-shaped element designed to engage the detents. The generally wedge-shaped element can be an accurately precision-ground element. In another embodiment, a single click element can engage the detents. The click element may be in a fixed position, the click element may be spring loaded, or some combination of fixed and spring loaded. For example, the click element that engages the first plurality of detents may be fixed and the click element that engages the second plurality of detents may be spring loaded. Alternatively, both click elements may be spring loaded. For example, if the groove depths of the first and second plurality of detents are substantially the same, the click element engaging the first plurality of detents may be spring loaded at a tension different from the click element engaging the second plurality of detents. The recitation of combinations of detent and click element structures is meant for merely illustrative purposes, and is in no way meant to limit the possible structures or structural combinations.

In addition, the turret cap mechanism of the scope can be removable and replaceable by a second turret cap mechanism. The turret cap mechanism can have a different click value from the second turret cap mechanism. The quick release mechanism provides a mechanical connection between the turret cap and the saddle mechanism such that upon removal of the turret cap mechanism, the internal seals of the scope would not be compromised. As a further embodiment, the turret cap mechanism can be removed without tools. A scope turret mechanism that can be removed may include a turret cap designed to engage a quick release mechanism such that when engaged, rotation of the turret cap will result in a shift in position of a scope reticle is further described herein. As described above, the quick release mechanism can comprise a threaded bolt, a pin, a lever, and a pressure plate. In one embodiment, the turret mechanism can further include a click ring. In another embodiment, the turret mechanism can further include at least two click rings. The turret cap can have a rim to contact the pressure plate of the quick release mechanism. The pressure plate is generally part of or connected to the threaded bolt. In another embodiment, the scope turret mechanism can comprise a click element designed to engage a click ring of a scope. In a further embodiment, at least one of the click rings can be a bullet drop compensation click ring. The detent spacing may be chosen to create a corresponding movement of the reticle. In a further embodiment, the quick release mechanism comprises a manually manipulable component. This kind of adjustment mechanism described herein is mainly used in, but not limited to, opto-mechanical instruments such as rifle scopes.

A rifle scope may include a main tube, the housing that holds the optical system, which again may include an objective system, an ocular (or eyepiece) system, and an erector system. The erector system might be a system with fixed magnification or a system with variable magnification (zoom). A reticle is placed either at the front end (first focal plane or objective focal plane) or/and at the back end (second focal plane or ocular focal plane) of the erector system. This reticle is the aiming mark for the user such that, when the rifle scope is properly adjusted to the rifle, the point of impact should be at the aiming point given by the reticle.

Because of the ballistic properties of the bullet; environmental conditions such as altitude, humidity, wind, etc.; and the distance to the target, the point of impact can vary compared to the originally set aiming mark. To allow the shooter to accommodate for these changing conditions, the scope is equipped with at least one (usually two) adjustment mechanisms. Each adjustment mechanism may be mounted to the main tube, usually one horizontally and another one vertically, so that the center axes of the two adjustment mechanisms make an angle of approximately 90°. The adjustment mechanisms are connected to the erector system. When the adjustment mechanisms are used, they provide a movement of the reticle on the image that is created by the objective system (first focal plane) or the objective and the erector system (second focal plane). Knowing or estimating the environmental conditions and other factors influencing the point of impact, the shooter can adjust the reticle position so that the expected point of impact will be at the aiming mark again.

The foregoing examples and example advantages may not be present in every configuration or for every technique. While generally described as a scope, some or all of these aspects may be further included in respective systems, components or other devices for configuring, implementing, or otherwise resulting in a suitable system or device. The details of these and other aspects and embodiments of the present disclosure are set forth in the accompanying drawings and the description below. But other features, objects, and advantages of the preferred embodiment will be apparent from the description and drawings. Functions and embodiments described before can work alone or combined in any suitable way.

FIG. 1 illustrates an embodiment of the adjustment mechanism 100, which may include three subassemblies: the saddle assembly 140, the turret cap assembly 120, and the quick spanner assembly 180.

As an example, the saddle assembly 140 may be mounted to the main tube of a rifle scope. It holds a transportation piece 144 into which a plunger 150 is attached (e.g., screwed). The bottom of the plunger 150 has two plane parallel surfaces which are led through a slot in the lower saddle part 152. This design ensures that the plunger 150 can move in or out of the saddle assembly 140 when the transportation piece 144 is rotated. The upper saddle part 142 holds spring-loaded click elements 146, 148 that engage the click rings 126, 128, respectively, in the turret cap assembly 120 to create the tactile and audible clicks. The lower and the upper saddle parts 142 and 152 are held together by screws, a cover "closes" the upper saddle part 142 on top. O-rings inside and around the saddle assembly 140 ensure that once this assembly is mounted to the scope's main tube, the scope is sealed and thus the inside of the scope is protected against dust and humidity. On either the saddle assembly 140 or the main tube, an index mark is positioned in a way that the user can "read" to which position the respective turret cap assembly 120 is set.

Figure 3:
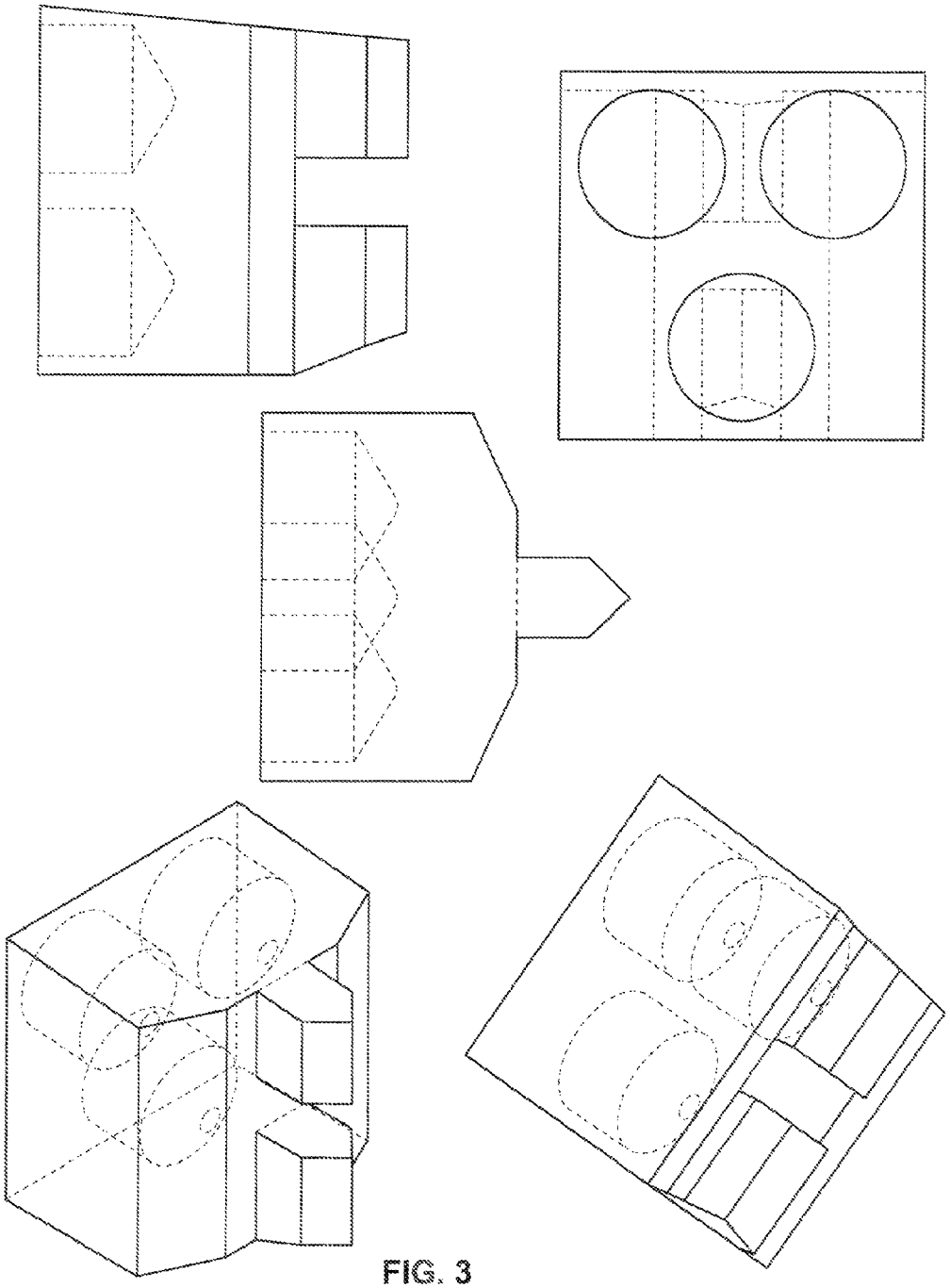
FIG. 3 is an illustration of example dimensions of the click element.

In embodiments, the click elements could be part of the turret cap assembly 120 and could engage click rings that are part of the saddle assembly 140. FIG. 3 is an illustration of example dimensions of the click element.

The turret cap assembly 120 is the part of the adjustment mechanism 100 that is normally handled by the user to move the reticle on the image in either the first or the second focal plane and thus influences the point of impact. In one embodiment, the turret cap assembly 120 may include the turret cap 122 and one or more click rings (e.g., 126, 128) that are held in the inside of the turret cap 122. The inside diameter of the click ring(s) has a certain amount of teeth 130, 132. The amount of teeth depends on the particular click value, scope's focal length, used thread pitch of the saddle assembly's 140 transportation piece 144 and plunger 150, etc. The click ring 126 is assembled into the inside diameter of the turret cap 122 and positioned and held in place by one or more pins and/or screws. If there is more than one click ring, they are assembled on top of each other and positioned to each other by one or more pins and/or screws. A scale 124 with marks, numbers, etc. may be located on the outside diameter of the turret cap 122; to provide reference to the "clicks" of the click rings.

The quick spanner assembly 180 connects the turret cap assembly 120 with the saddle assembly 140 which allows the transportation piece 144 to follow when the turret cap assembly 120 is rotated. Thus, the saddle assembly's plunger 150 moves in or out of the saddle assembly 140. The quick spanner assembly 180 may include a threaded bolt 186, a pin 185, a lever 182, and a pressure plate 184. On the top of the threaded bolt 186 is a hole whose axis is perpendicular to the threaded bolts' main axis. One end of the lever 182 may be cylindrical in shape 183. Other shapes, such as oval, diamond, wedge-shaped, or other shapes, as appropriate, that can apply pressure contact are contemplated. Through this cylinder is a hole, the axis of which is eccentric to the cylinder axis. The pressure plate 184 has a slot through which the top of the threaded bolt 186 is placed. In another example, the pressure plate 184 may be part of the threaded bolt 186. The lever 182 is placed on the top part of the threaded bolt 186 so that the holes of the threaded bolt 186 and the lever 182 line up.

Figure 2:
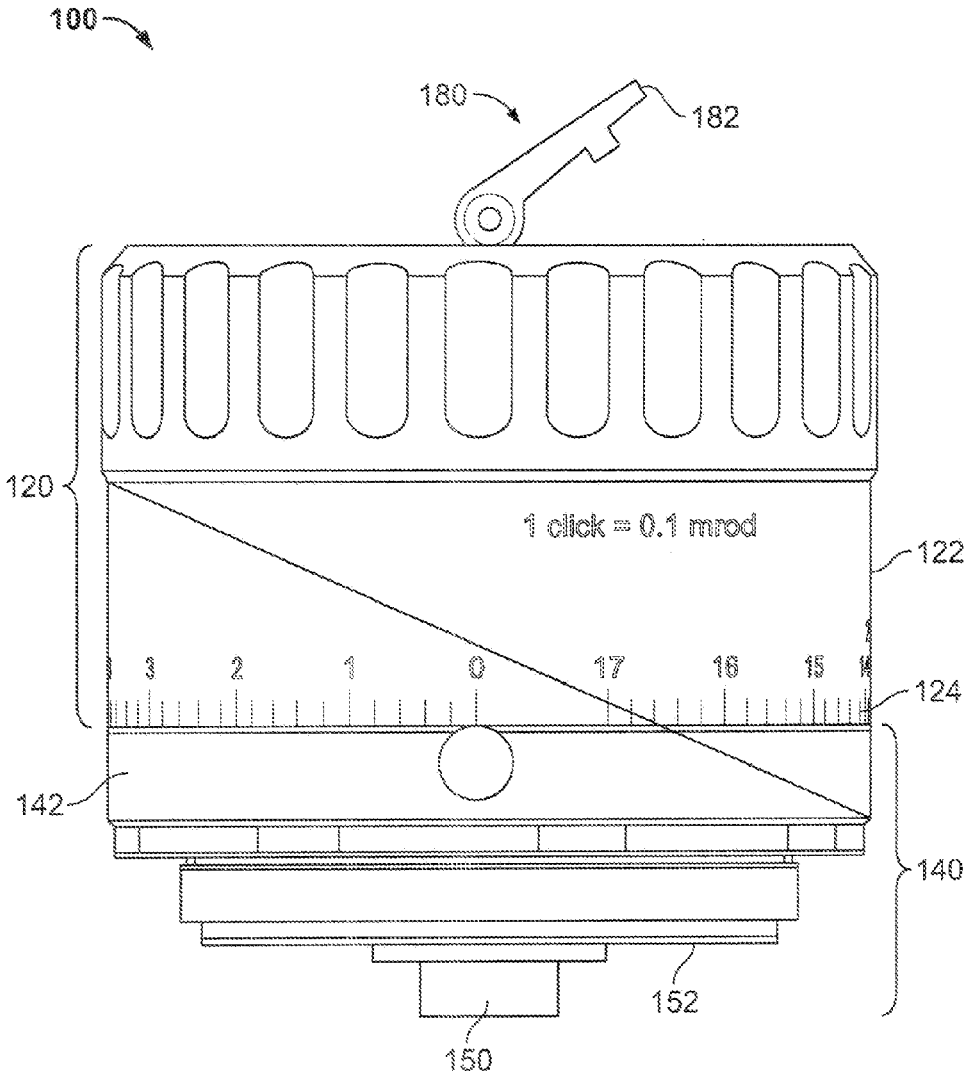
FIG. 2 is an unexploded view of an example embodiment of the adjustment mechanism of FIG. 1 showing the turret cap assembly mounted onto the saddle assembly.

The turret cap assembly 120 is mounted to the saddle assembly 140 such that it almost completely covers the saddle assembly 140, as shown in FIG. 2. A first inside diameter in the turret cap 122 attaches to the outside diameter of the saddle assembly's transportation piece 144 shown in FIG. 5. The turret cap 122 may fit onto the saddle assembly 140 by a friction fit or some other secure and removable way. A rim 134 (shown in FIG. 5) on top of the turret cap's inside diameter places the turret cap assembly 120 on the transportation piece 144. The click element 146, 148 in the saddle assembly 140 engage the turret cap assembly's 120 click rings' 126, 128 teeth 130, 132, respectively, which creates the tactile/audible clicks when the turret cap assembly is rotated. It is to be understood that a turret cap assembly with a click ring with a first number of detents or teeth may be interchanged with another turret cap assembly with a click ring with a second number. The turret cap assemblies may be structured such that the number of detents or teeth on the rings contained therein would not affect the coupling of the turret cap assembly 120 to the saddle assembly 140. For example, the turret cap assemblies may have the same configuration, except for the number of detents or teeth on the click ring. The click ring may be removable and replaced with a second click ring with a different number of detents or teeth (as long as the second click ring is mechanically compatible with the structure of both the turret cap assembly and the saddle assembly).

The pin 185 is inserted through the holes, becoming an axle for the lever 182. The hole in the lever 182 is sized in a way that the pin 185 must be pressed through, whereas the hole in the threaded bolt 186 is larger in diameter than the pin 185. This allows the pin 185 to be held in place by the press fit diameters, yet permits the lever 182 to be rotated around the axle. When the turret cap assembly 120 is placed on the saddle assembly 140, the threaded bolt 186 of the quick spanner assembly 180 is screwed into a thread on top of the saddle assembly's transportation piece 144. The quick spanner assembly's pressure plate 184 comes to sit on top of the turret cap assembly's rim 134 (shown in FIG. 5, which again is sitting on top of the saddle assembly's transportation piece 144). The quick spanner assembly's bolt 186 is screwed so far in that in order to move the lever 182 into the spanned position a certain force has to be applied. When the lever 182 is rotated into the spanned position, the bolt 186 is "pulled up" in the thread and, thus, force in the thread is created. The frictional force created between turret cap 122 and transportation piece 144 may establish the mechanical connection there between and allow rotating the transportation piece 144 via the turret cap 122. The deeper the bolt is screwed into the transportation piece 144, the more force that is applied to the thread, and vice versa. This means that the tension of the quick spanner assembly mechanism 180 can be adjusted when spanning the mechanism.

With the quick spanner assembly 180 in spanned position, the forces created between the bolt's 186 and transportation piece's 144 thread, the turret cap assembly's ring (e.g., 126), the pressure plate 184, and the lever 182, it is provided that when the turret cap assembly 120 is rotated by the user, the transportation piece 144 follows this movement and, thus, the plunger 150 moves in or out (depending on rotation direction) of the saddle assembly 140.

The adjustment mechanism 100 may move the aiming mark (reticle) on the image created in the first or second focal plane in order to influence the point of impact. To accomplish this, the front end of the erector system is pressed against the bottom of the saddle assembly's plunger 150 by one or more springs. The back of the erector system is connected to the main tube in a ball joint, allowing pivoting of the erector system when the adjustment mechanisms' turret cap assembly 120 is rotated. The front end and/or the back end of the erector system may hold an aiming mark (reticle) in the rifle scope's first or second focal plane, depending on the designated use of the scope and the user's preferred configuration. Rotating the turret cap assembly 120 results in a movement of the reticle relative to the image.

During the adjustment process, the turret cap assembly 120 is rotated by a certain amount of increments, further referred to as "clicks" or "click adjustment." Depending on the total adjustment range and/or the graduation of the click adjustment (travel per click), many different versions of the adjustments with either one or multiple rotations of the turret cap can be put into realization. One click adjustment would be referred to as "1 cm/100 m," which means that every click changes the point of impact by 1 cm when the target is at a distance of 100 m. Some other click adjustments could be, for example, ¼ MOA or ¼ inches at 100 yards.

The turret cap assembly 120 is connected to a female transportation piece (in the saddle assembly 140), which transfers the turret cap assembly's rotational movement into a linear movement (along the axis) of the plunger 150. A certain amount of rotational movement (clicks) results in the respective change or correction of the point of impact. The adjustment value can be determined (or set) using the scale that is on the outside diameter (usually, but not necessarily, engraved) on the turret cap 122.

To achieve the adjustment in certain click values, the turret cap 122 holds one or more click rings 126, 128. Each click ring 126, 128 have a certain amount of teeth 130, 132, respectively, depending on the desired click value. The turret cap assembly 120 can be switched by the user, providing the user with several different turret cap assemblies and a choice of click values.

Two different click values may be achieved in one adjustment mechanism by using a second click ring 128 in the same turret cap with a teeth 132 graduation differing from the first click ring 126. Using different spring configurations for the two click mechanisms 146, 148 results in a differing tactile feel and/or differing "click sound" when an adjustment is made and thus can, for example, make counting of higher click numbers easier. A single click ring may also be used, with two sets of detents, each set having a different gradation from the other. A single click element may also be used with a single spring configuration. The click elements may be one piece or may be more than one, depending on the configuration. The click element may be any chosen structure, structures, or mechanisms that engage the detents or teeth.

In one embodiment, to achieve the differing tactile feels of the click mechanisms, different click elements with differing spring pressures may be assigned to the click rings. Shown by example in FIG. 5, the click elements 146, 148 are aligned on top of each other allowing an exact alignment of the two click adjustments. One or more springs 156, 158 with defined spring pressure press the click element into the teeth of each click ring 126, 128, respectively. In another embodiment, a single click element may span two or more click rings and may have a continuous engagement face or a divided engagement face that engages the detents of the click rings.

The use of two click rings at the same time allows for combinations of primary click adjustment and secondary click adjustment. For example, one click of the secondary click adjustment can equal a certain amount of clicks of the primary click adjustment, thus making counting of higher click amounts easier. Another example could be that the primary click adjustment equals a certain shift in point of impact (for example 0.1 mil per click) and the secondary clicks refer to different distance adjustment for a certain ammunition type.

Referring to FIG. 2, the scale 124 on the outside diameter of the turret cap 122 matches the click adjustment of primary and/or secondary click adjustments. The design of the scale 124 can be made to show whatever the user prefers. An example could be that the scale 124 shows low lines and some higher lines, where the low lines refer to every click of the primary click adjustment and the higher lines refer to every click of the secondary click adjustment.

Figure 5:
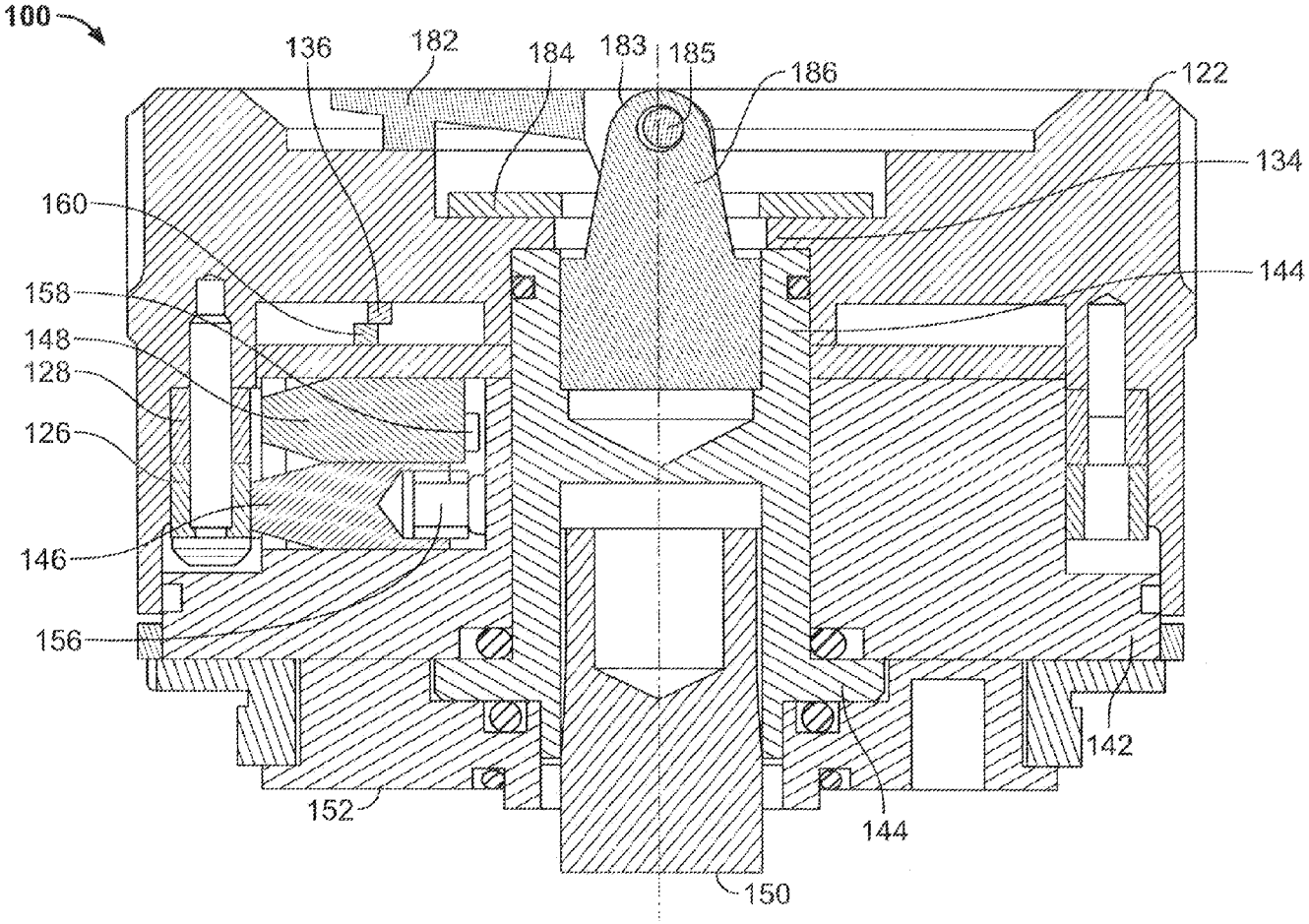
FIG. 5 is an example side cross-sectional view of one embodiment of the adjustable mechanism of the present disclosure.

FIG. 5 is a cross-sectional schematic of the adjustment mechanism. FIG. 5 illustrates a stop pin 160 projecting out of the top of the saddle assembly 140 and another stop pin 136 projecting out of the bottom of the turret cap assembly 120 to provide (a) a defined "zero stop" at the one end of the adjustment range and (b) a defined stop at the end of the adjustment range, while only one revolution of the adjustment mechanism 100 is used.

The quick spanner 180 shown in FIG. 1 allows the user to set/reset or switch the turret cap assembly 120 without the use of any special tools by mechanically coupling to the saddle assembly 140 and allowing for the application of a force that secures the turret cap assembly 120 to the saddle assembly 140 by a mechanical lever 182 readily accessible to the user. Situations that make it desirable to open the quick spanner 180 could arise when sighting in the rifle, adjusting the adjustment mechanism 100 due to changed environmental conditions, switching the rifle scope from one rifle to another, or accommodating changes in point of impact due to use of special auxiliary equipment (for example, suppressors).

Figure 4:
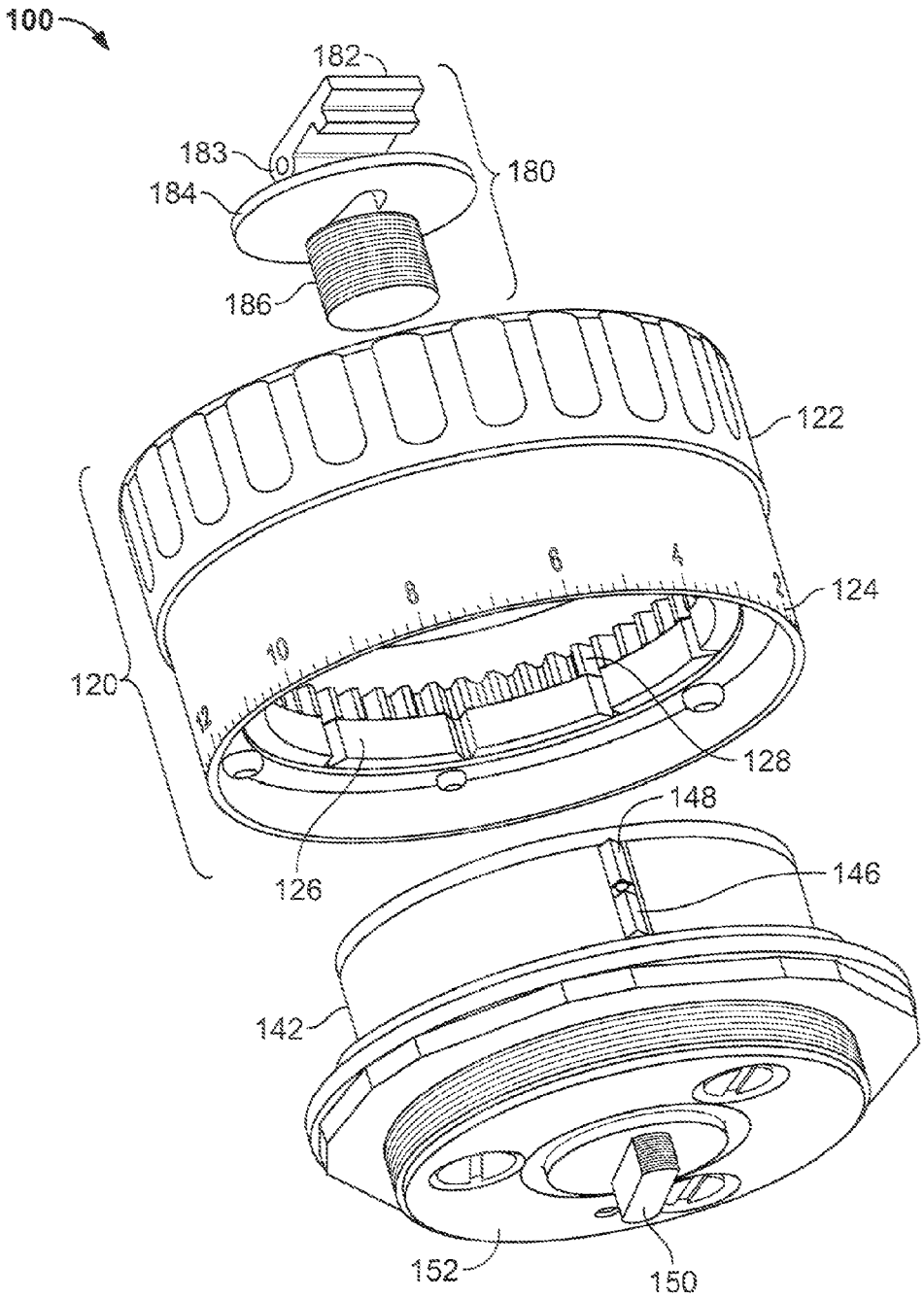
FIG. 4 is an example partially exploded view of the adjustment mechanism of the present disclosure showing unexploded views of the turret cap assembly, the saddle assembly, and the quick spanner assembly.

When the quick spanner assembly 180 is assembled to the adjustment mechanism 100 the quick spanner 180 will usually be in its unlocked position, with its lever 182 pointing up (as shown in FIG. 2. The quick spanner's threaded bolt 186 is screwed through a hole in the turret cap assembly 120 into the upper inside thread of the transportation piece 144 of the saddle assembly 140. The quick spanner assembly's pressure plate 184 comes to sit on a rim 134 (shown in FIG. 5) of the turret cap 122 which, again, is sitting on top of the transportation piece 144. The quick spanner 180 is screwed far enough into the transportation piece 144 that its lever 182 touches the pressure plate 184 in the unlocked position. To lock the quick spanner 180, the lever 182 is pushed down into the locked position (as shown in FIG. 4). Because the end of the lever 182 holding the axle is eccentric to the axle, the threaded bolt 186 is pulled up in the transportation piece's 144 thread and the pressure plate 184 is pressing the turret cap assembly 120 against the transportation piece 144. The tension of the quick spanner 180 can be influenced by unlocking it, screwing the bolt 186 in or out more (depending on if higher or lower tension is to be used), and locking it again. In another embodiment, the pressure of the plate 184 could be controlled by a spring mechanism which provides a preset pressure for locking the pressure plate 184.

To unlock the quick spanner 180, a simple device such as a coin, key or bottom rim of a cartridge, may be used. The device is used as a lever by pushing one end of it underneath the quick spanner's lever 182 and pressing the other end down so the quick spanner's lever 182 lifts up. Because the end of the quick spanner's lever 182 has a cylindrical shape 183 which is eccentric to its axle, the force is taken off the pressure plate and, thus, the force is taken out of the threads and the quick spanner assembly 180 is unlocked.

FIG. 5 illustrates the lever 182 of the quick spanner assembly 180 in the "locked" position. FIG. 5 also shows the spring loaded click elements 146, 148 engaging the detents in the click rings 126, 128, respectively. The threaded bolt 186 of the quick spanner assembly 180 connects to the transportation piece 144, which, when the lever is locked, moves the plunger in or out of the saddle, thereby effecting the position of the aiming mark. When the quick spanner is unlocked, the turret cap assembly 120 can be rotated without the transportation piece 144 following, the plunger 150 will not move in/out of the saddle assembly 140. Thus, the aiming mark (reticle) will not change its position on the image.

To remove the turret cap assembly 120 from the saddle assembly 140, the threaded bolt 186 may be unscrewed and the quick spanner assembly 180 removed. Upon replacing the turret cap assembly 120 onto the saddle assembly 140, the quick spanner assembly 180 would thus be reconnected.

In some uses, the adjustments sought make it desirable to have more than one revolution of the turret. This could be, for example, to achieve a higher elevation range in order to be able to shoot at further distances. Another example could be that the click adjustment has to be very fine and since the amount of clicks per revolution is mechanically limited by the size of the teeth, in order to achieve the desired elevation range, more than one revolution of the turret is desirable. A combination of these two examples may be possible.

One complication of having more than one revolution of the turret cap assembly 120 is that the user not only has to know at which rotational position the turret cap assembly 120 is at a given time, but also in which revolution the mechanism is.

Figure 6:
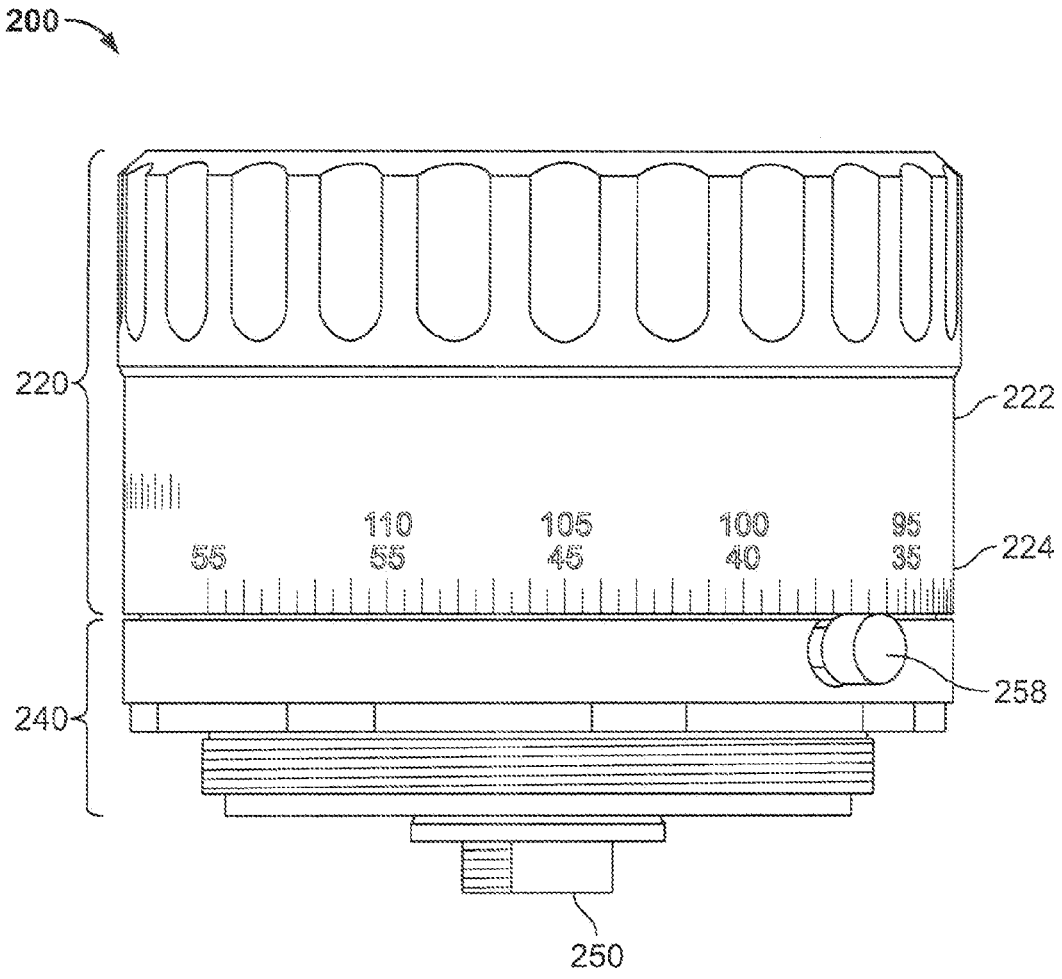
FIG. 6 is an illustration of an example embodiment of the adjustment mechanism of the present disclosure configured for multiple revolutions.
Figure 8:
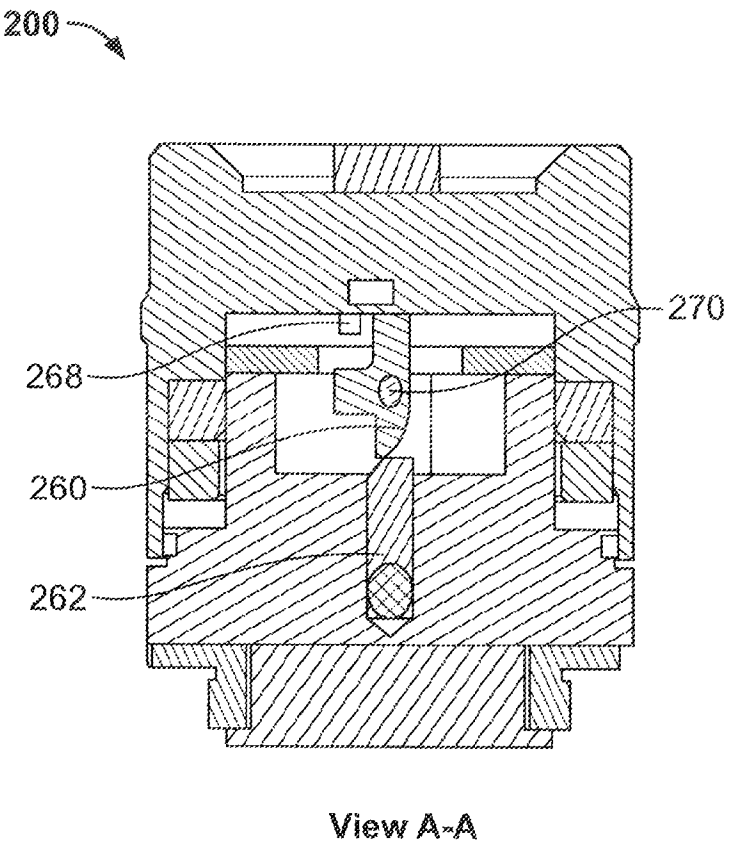
FIG. 8 is an example side cross-sectional view of the embodiment of the adjustment mechanism of FIG. 7 taken along A-A.
Figure 7:
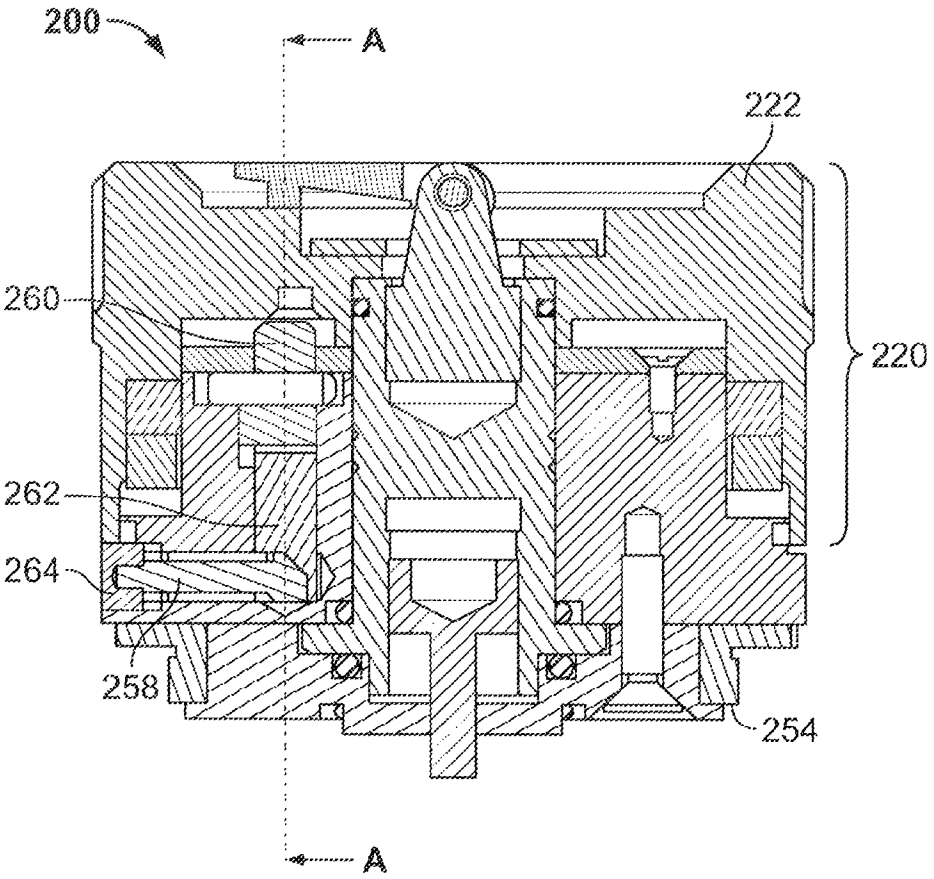
FIG. 7 is an example side cross-sectional view of an embodiment of the adjustment mechanism of the present disclosure configured for multiple revolutions.

FIGS. 6-8 illustrate an embodiment of the adjustment mechanism 200 for multiple revolutions. FIG. 6 shows an adjustment mechanism 200 with two revolutions set to the second revolution. In the adjustment mechanism 200 of FIG. 6, an indicator 258 shows the revolution stage of the turret cap assembly 220 is added to the adjustment mechanism 200, where the adjustment mechanism 200 works as described above. The revolution indicator 258 protrudes out of the saddle assembly 240 and is not only visible to the user, but also tactile. Thus, in bad light conditions or under stress, the user can "feel" to which revolution the adjustment mechanism is set, which can mitigate misreading the position of the adjustment mechanism. The revolution indicator 258 can also serve as the index mark for the turret cap assembly's scales 224. As shown in FIG. 6, for the two-revolution version of the adjustment mechanism, there are two scales 224 on the turret cap 222, located on top of each other. The revolution indicator 258 being flush with the outside diameter of the saddle assembly 240 would indicate "first revolution" and, thus, the lower scale would indicate the turret cap 222 position; the revolution indicator 258 protruding out of the outside diameter of the saddle assembly 240 would indicate "second revolution," and, thus, the upper scale would indicate the turret cap 222 position.

FIG. 7 is a side cross-sectional schematic of the embodiment of the adjustment mechanism 200 configured for multiple revolutions; and FIG. 8 is a side cross-sectional view of the embodiment of the adjustment mechanism of FIG. 7 taken along A-A.

For the adjustment mechanisms with multiple revolutions, the saddle assembly 240 is not equipped with a stop pin. The revolution indicator 258 replaces it and serves this purpose, as well.

The revolution indicator 258 may include a rocker element 260 with a pin 270 functioning as its axle, a vertically oriented transmission bolt 262 with an angled surface at its bottom, and a horizontally oriented indicator bolt 264 with an angled surface at its back side which is touching the bottom surface of the transmission bolt 262. A lock ring 254 holds the indicator bolt 264 in the saddle assembly 240, and a spring constantly pushes the indicator bolt inward against the transmission bolt.

Figure 9:
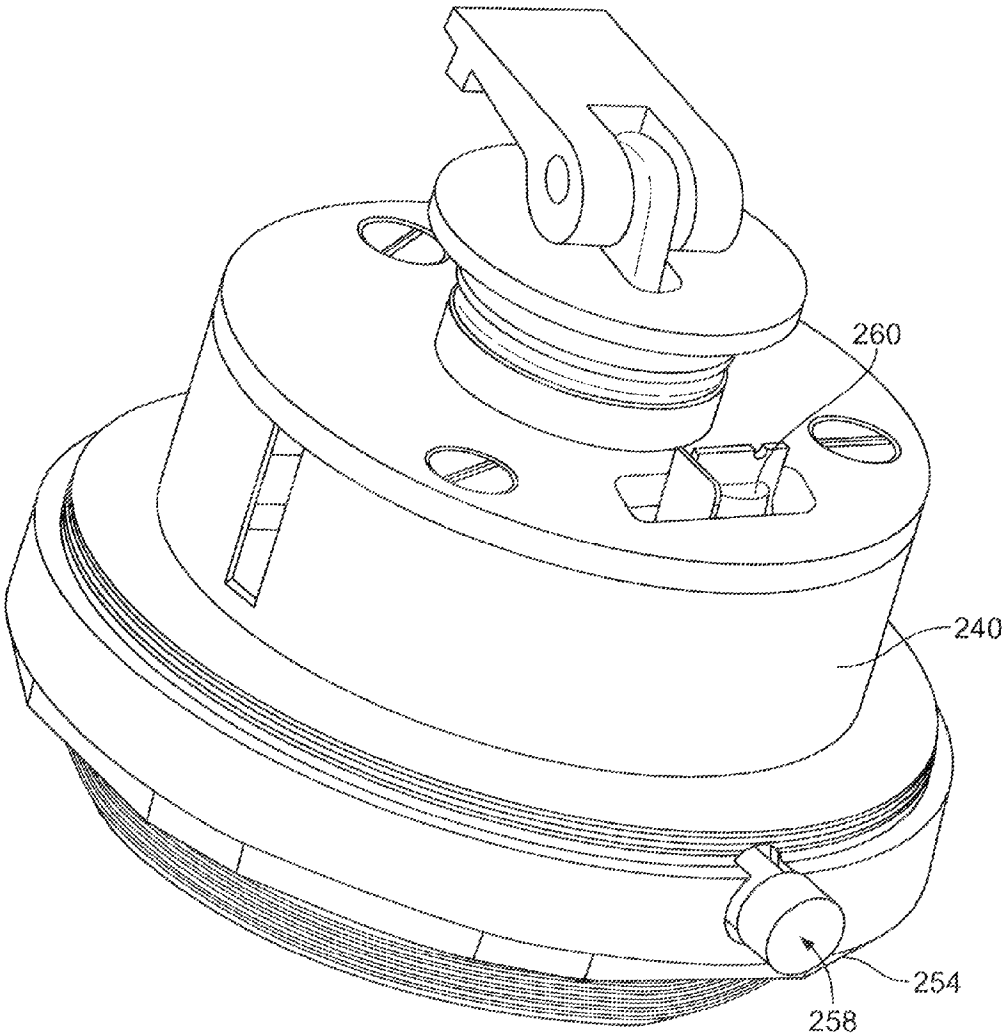
FIG. 9 is an illustration of the embodiment of the adjustment mechanism of the present disclosure configured for multiple revolutions shown without the turret cap assembly.

FIG. 9 shows the adjustment mechanism without the turret cap assembly, showing the rocker element 260 on top of the saddle assembly 240 and indicator bolt 258 protruding out of the outside diameter of the saddle assembly 240.

The main functionality of the adjustment mechanism resembles the previously described versions, but with only one revolution. One difference is that, in this embodiment, multiple revolutions are possible.

As shown in FIGS. 7 and 8, the rocker element 260 has at least two straight "arms" and an additional arm with a radius that is eccentric to the rocker element's axle. When the turret cap assembly 220 is rotated to the beginning of the first revolution (into direction of the "zero stop"), the stop pin protruding out of the bottom of the turret cap 222 "hits" the back side of the rocker element's 260 arm. The flat side of the rounded arm hits the bottom of the saddle assembly cover and, thus, the rocker element 260 can't "flip over," creating the "zero stop." When the turret cap assembly 220 is rotated into the opposite direction by a whole revolution, the turret cap assembly's stop pin touches the rocker element's arm on the "inside." Since the radiused arm is not preventing movement in this direction, the rocker element 260 is "flipped over" around its axle. Because the radius of the additional arm is eccentric to the rocker element's axle, the transmission bolt 262 is pressed downward, and due to the angled surfaces of both the transmission bolt 262 and the indicator bolt 264, the indicator bolt 264 is pushed out of the saddle assembly 240. The user can now see and feel the indicator bolt 258 protruding out of the saddle assembly 240, indicating that the adjustment mechanism 200 is now in the second revolution. When the turret cap assembly 220 is rotated the whole second revolution, the turret cap assembly's stop pin will again touch the back side of the other rocker element's arm. Because the rocker element's radiused arm is already pushing the transmission bolt 262 down into the saddle assembly 240, it can't flip the rocker element 260 over another time, creating the "adjustment range maximum stop." When rotating the turret cap assembly 220 back into the first revolution, the rocker element 260 flips back over again. The indicator bolt 258 is pushed back in again by the spring and pushes the transmission bolt 262 upward against the radiused arm of the rocker element 260. The indicator bolt is now flush with the outside diameter of the saddle assembly 240 again, indicating that the adjustment mechanism 200 is in the first revolution.

The rocker element 260 and the turret cap 222 are shaped in a way that the rocker element 260 can only "flip over" when the turret cap assembly's stop pin is engaging the "inside" of one of the rocker element's arms. For this, the rocker element has a corner between its arms (shown in FIG. 9) and the bottom of the turret cap 222 has a slot at its bottom (shown in FIGS. 7 and 8). The rocker element's corner would hit the bottom surface of the turret cap 222, preventing it from flipping over without the turret cap assembly's stop pin 268 engaging it. When the stop pin 268 is engaging the rocker element, the corner would travel through the slot, allowing it to flip over. This design prevents a wrong indication of the actual revolution setting.

Other possible embodiments would be to allow for three or even more revolutions by changing the shape of the rocker element 260 in a manner that provides the use of more than two arms. In this case, each revolution setting would result in a different position of the indicator bolt, protruding to various lengths or even being further inside the saddle assembly so that the user can feel/see a "hole" on the outside diameter of the saddle assembly 240 as an indication of the actual revolution setting of the adjustment mechanism.

It may be desirable to protect against inadvertent rotation of the turret cap assembly 220 and, thus, inadvertent movement of the aiming mark.

Figure 10:
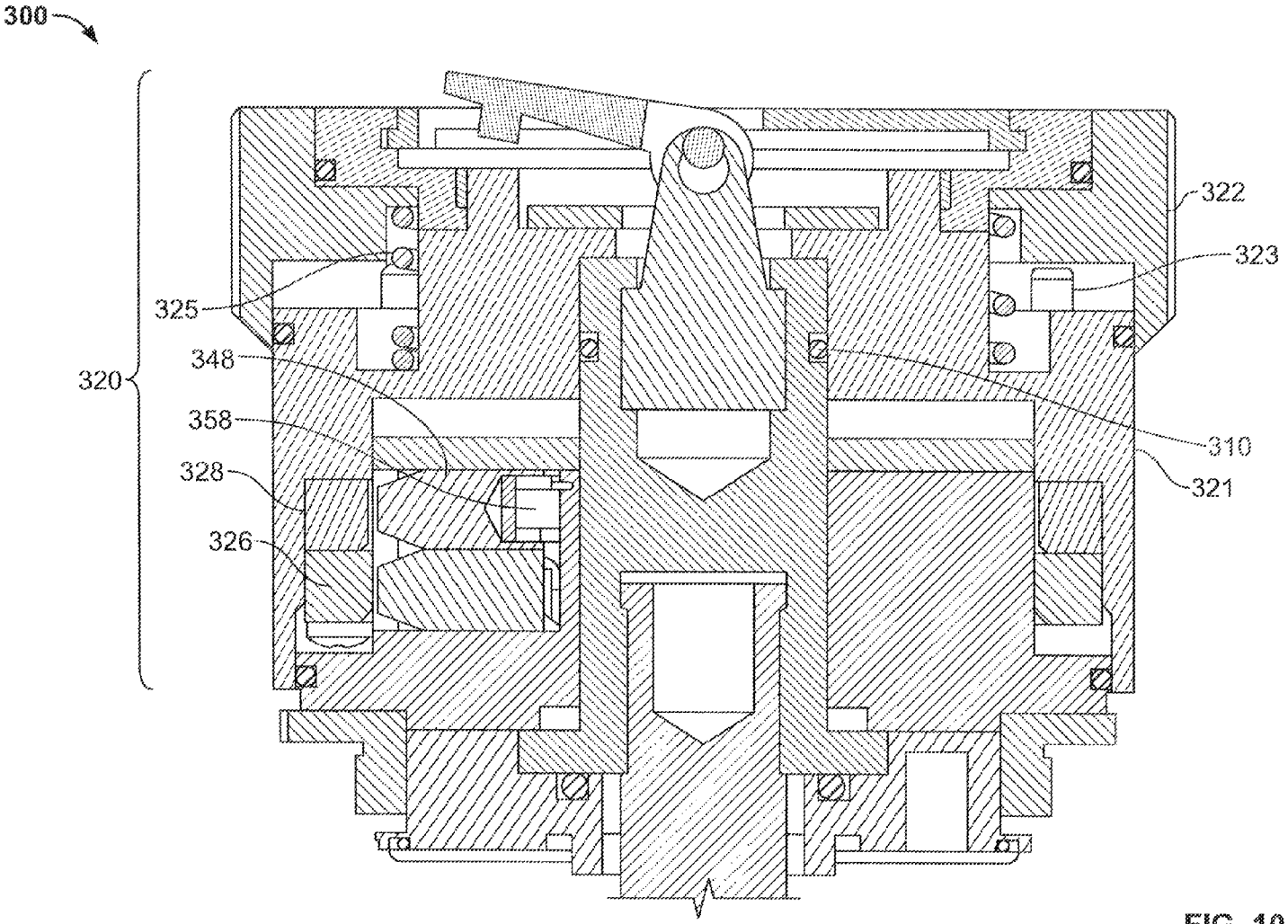
FIG. 10 is an example side cross-sectional view of one embodiment of the adjustment mechanism of the present disclosure with a two-stage turret cap assembly.

FIG. 10 is a side cross-sectional view of an embodiment of the adjustment mechanism 300 of the present disclosure with a two-stage turret cap assembly. The turret cap assembly 320 of this embodiment consists mainly of two separate components: a lower turret cap assembly 321, which contains the click rings 326, 328 inside, the scales on the outside diameter, and an upper turret cap assembly 322, which may be touched by the user to make the necessary adjustments. FIG. 10 shows that click element 348 can be spring loaded with a spring 358. The lower turret cap assembly 321 has several pins 323 protruding out of the top surface, arranged in a circle and spaced at equal angles. The upper turret cap assembly 322 has multiple holes 325 at the bottom surface, arranged in a circle matching the diameter of the circle in which the pins 323 in the lower turret cap assembly 321 are arranged. The angle spacing of the holes is arranged in a way that the angle spacing of the pins in the lower turret cap assembly 321 is an even multiple of the angle spacing of the holes in the upper turret cap assembly 322. The holes 325 have countersinks. The amount of holes and size of the countersinks is arranged in a way that the countersinks are slightly overlapping each other. The upper turret cap assembly 322 is sitting on top of the lower turret cap assembly 321 and is pressed upward against a lock ring that prevents it from coming off completely.

In idle mode, the lower turret cap assembly 321 may not follow the rotational movement of the upper turret cap assembly 322 when it is (inadvertently) rotated (e.g., if it is bumped or nudged), and, consequently, no inadvertent aiming mark movement would occur. The lower turret cap assembly 321 could still be rotated intentionally, though, resulting in a change of the aiming mark position. When the upper turret cap assembly 322 is pressed down against the spring, the pins 323 protruding out of the top of the lower turret cap assembly 321 will engage the countersinks of the upper turret cap assembly's holes 325 and, thus, self-center the holes to the pins 323; the pins 323 will then slide into the holes themselves. While keeping the upper turret cap assembly 322 pressed down and at the same time rotating it, the lower turret cap assembly 321 will follow this rotational movement, which will change the aiming mark's position on the image.

When the upper turret cap assembly 322 is released again, the spring pin 323 pushes it upward and the pins 323 disengage the holes 325. The upper turret cap assembly 322 rotates free without any other components following the rotational movement.

The construction of this embodiment can also be turned upside down, with the spring pushing the upper part downward in idle position. In this configuration, either pins or holes may be in the lock ring holding the upper turret cap assembly 322 on the lower turret cap assembly 321, and their counterpart may be in the upper turret cap assembly 322. When the lower turret cap assembly 321 follows the rotational movement of the upper turret cap assembly 322 (and, thus, doing an adjustment of the aiming mark position), the upper turret cap assembly 322 may be pulled upward against the spring.

Figure 11:
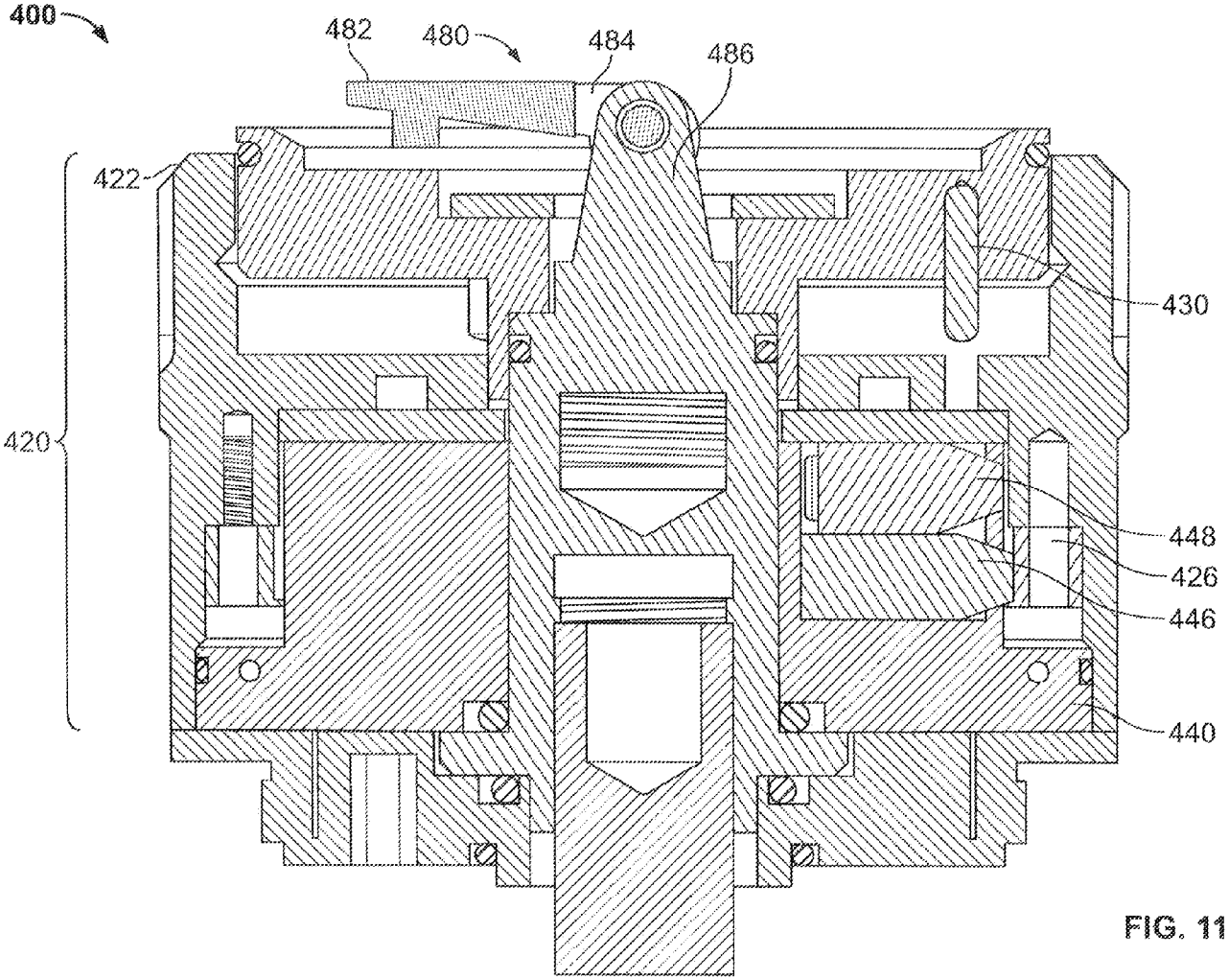
FIG. 11 is an example side cross-sectional view of an embodiment of the adjustment mechanism of the present disclosure with longitudinally depressed turret cap assembly.

FIG. 11 is a side cross-sectional view of an embodiment of the adjustment mechanism 400 of the present disclosure with longitudinally depressed turret cap assembly. In this configuration, the saddle assembly 440 can have a fixed or non-spring-loaded click element 446 and a spring-loaded click element 448. The turret cap assembly 420 can have a click ring 426 and be movable rotatably and longitudinally (pulled in or out) in relationship to the saddle assembly 440 as described above. In such an embodiment, the fixed click element 446 could engage the click ring 426 when the turret cap assembly 420 is in the down or "locked" position, thus preventing or minimizing the ability of the turret cap dial 422 to rotate in relation to the saddle assembly 440. In this configuration, when the turret cap assembly 420 is raised or in the up or "unlocked" position, the spring-loaded click element 446 could engage the click ring 426.

Figure 12:
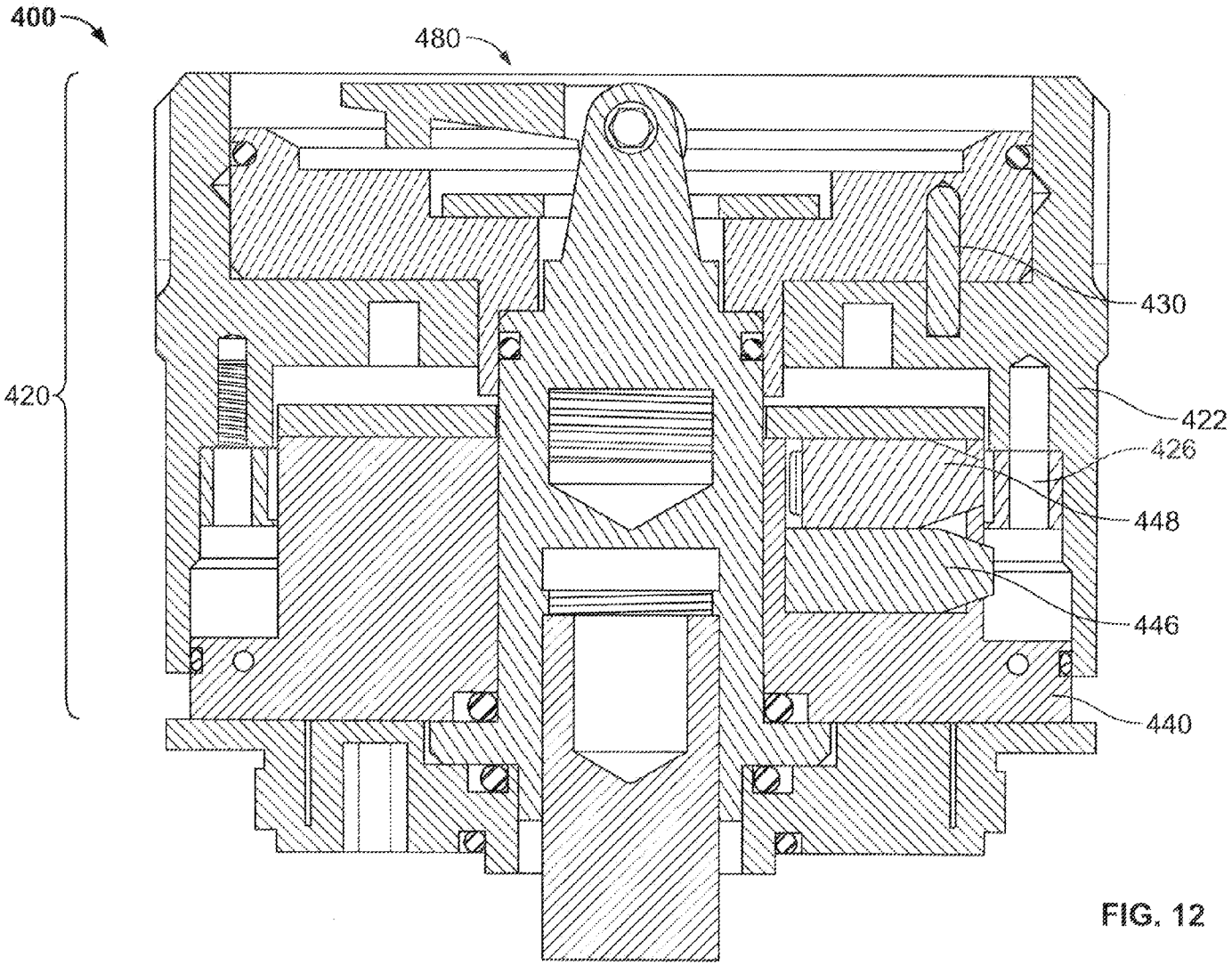
FIG. 12 is an example side cross-sectional view of the embodiment of the adjustment mechanism of FIG. 11 showing the turret cap assembly longitudinally raised.

One example of this configuration is illustrated in FIGS. 11-12 with a single click ring 426 connected to a dial 422 that is part of the turret cap assembly 420 in the down or "locked" position and engaging the fixed or "non-spring-loaded" click element 446. Further, as seen in FIG. 11, in this embodiment, even if the dial 422 were to rotate, it would not cause any or a substantial movement of the reticle because the dial 422 is not engaging the portion of the turret cap mechanism that is engaged by the spanner mechanism 480 (made up of lever 482, eccentric cam 484, and threaded bolt 486).

FIG. 12 is a side cross-sectional view of the embodiment of the adjustment mechanism of FIG. 11 showing the turret cap assembly longitudinally raised. The dial 422 with a single click ring is in the up or "unlocked" position and engaging the moving or "spring-loaded" click element 448. The dial 422 is also engaging the portion of the turret cap mechanism that is engaged by the spanner mechanism 480 as illustrated by pin 430.

Alternatively, the fixed click element 446 could engage the click ring 426 when the turret cap mechanism and/or the dial is in the up position and the spring-loaded click element 448 could engage the click ring 426 when the turret cap mechanism and/or dial 422 was in the down position. As a further embodiment, the turret cap assembly and/or the dial 422 could be spring-loaded relative to each other and/or the saddle assembly 440 such that spring loading encourages the turret cap mechanism and/or dial to be in either the up or down position. It can be understood that the click ring or rings 426 may be part of the saddle assembly 440 and the click element or elements may be part of the turret cap or dial assembly. Another embodiment may be that the dial also contains MTC ("more tactile click") ring elements that contain a smaller number of click-teeth.

Alternatively, a single click ring could comprise major and minor click detents to provide a more tactile click. Another method of locking the turret could be to use a pin or other form of locking mechanism to engage the moving "spring-loaded"

click element, thus preventing the dial's click ring from being able to overcome the engagement pressure.

The previously described mechanisms are protected from dirt, etc. by o-rings, as illustrated in FIG. 10 (e.g., o-ring 310). The rifle scope can be environmentally sealed as soon as the saddle assembly, independent of the used embodiment, is assembled to the main tube.

Figure 13A:
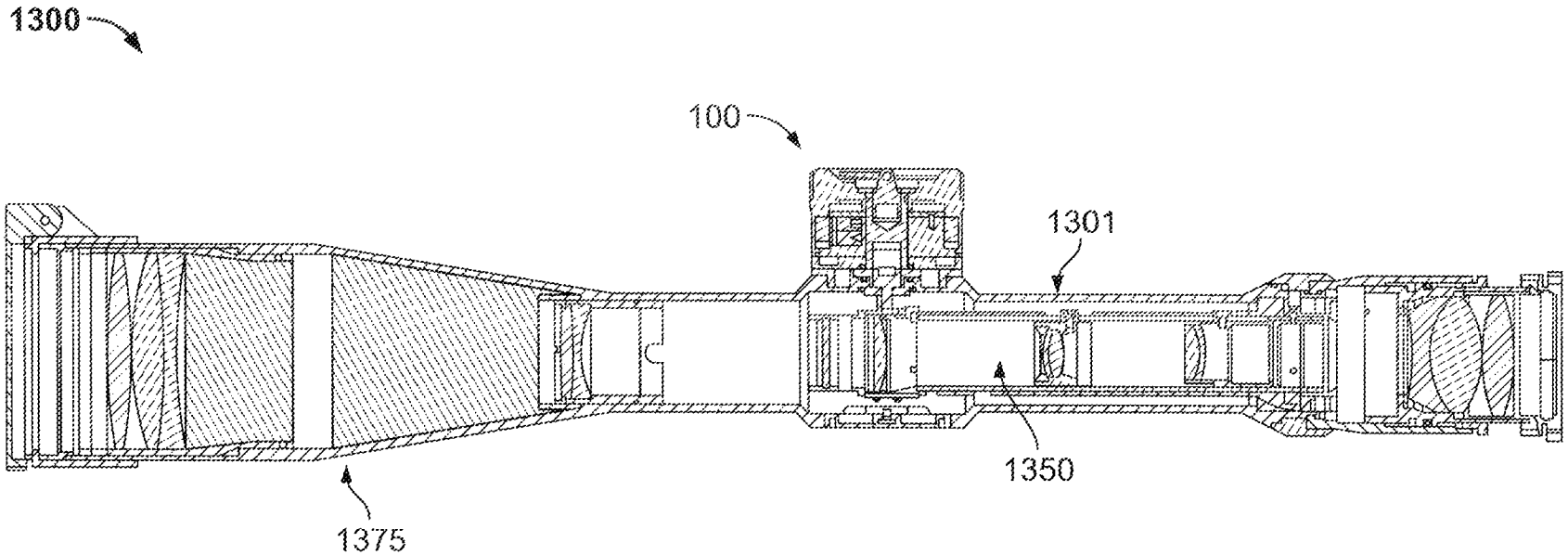
FIG. 13A is an example side-cross sectional view of a scope with an embodiment of the adjustment mechanism consistent with the present disclosure.

FIG. 13A is a side cross-sectional schematic of a scope 1300 consistent with the present invention. FIG. 13A illustrates scope 1300 with tube 1301, scope adjustment mechanism 100, erector system 1350, and objective system 1375. The erector system 1350 may further include an adjustment mechanism system 100 rotatably connected to the tube 1301 such that the adjustment mechanism system 100 provides movement of a reticle on an image that is created by the objective system 1375.

Figure 13B:
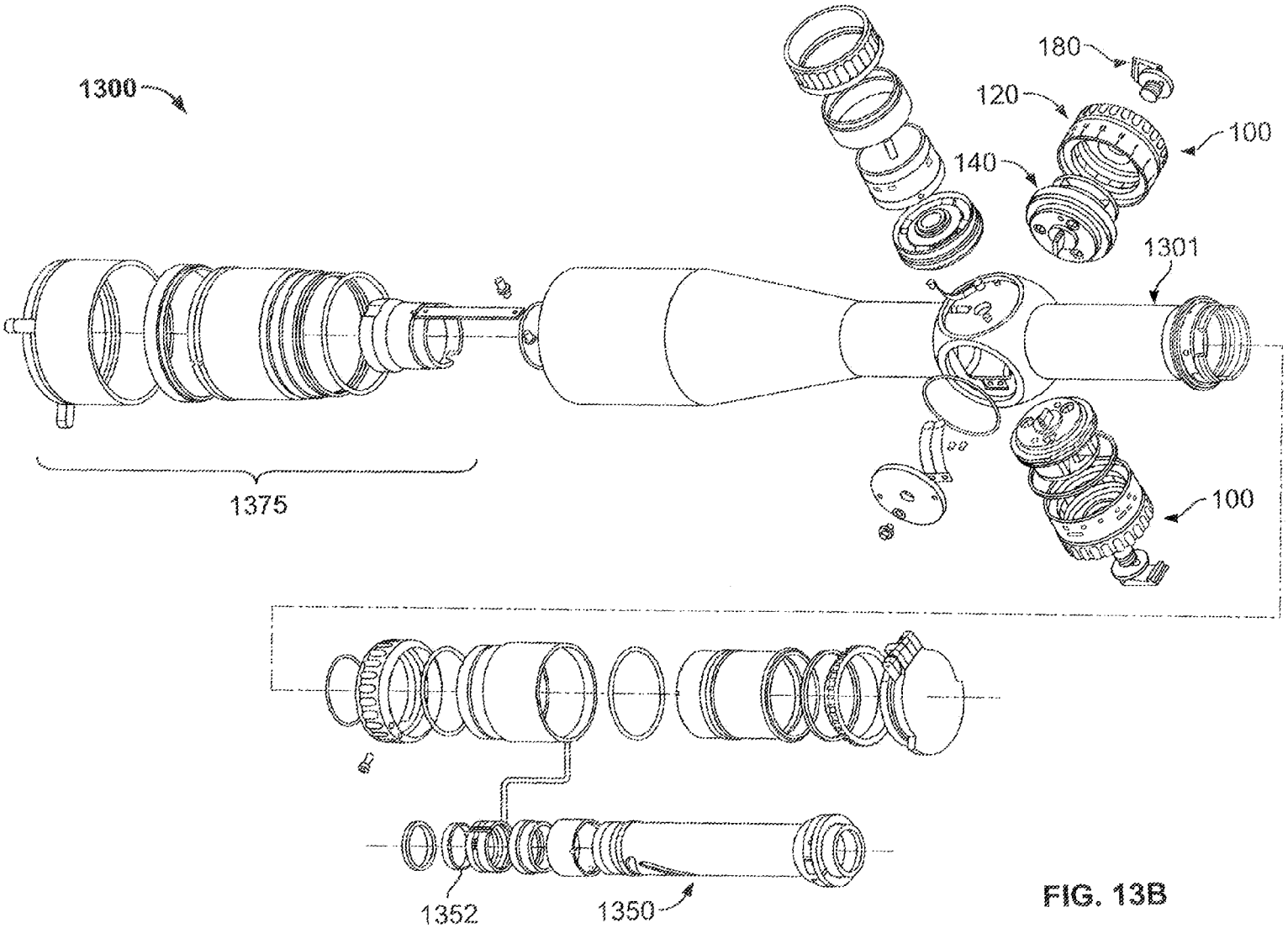
FIG. 13B is an exploded view of the scope of FIG. 13A.

FIG. 13B is an exploded view of the scope of FIG. 13A. The erector system 1350 may be a system with fixed magnification or a system with variable magnification (zoom). A reticle 1352 is placed either at the front end (first focal plane or objective focal plane) and/or at the back end (second focal plane or ocular focal plane) of the erector system 1350. This reticle 1352 is the aiming mark for the user such that, when the rifle scope 1300 is properly adjusted to a rifle, the point of impact should be at the aiming point given by the reticle 1352.

The figures and accompanying description illustrate example techniques, components, and configurations. This disclosure contemplates using or implementing any suitable method for performing, producing, configuring, or utilizing these and other components. It will be understood that the figures are for illustration purposes only and that the described or similar embodiments may be performed at any appropriate time, including concurrently, individually, or in combination. In addition, many of the features or tasks involving components in these embodiments may take place relatively simultaneously and/or in different configurations than as shown. In short, although this disclosure has been described in terms of certain embodiments and generally associated methods, alterations and permutations of these embodiments and methods will be apparent to those skilled in the art.

Accordingly, the above description of example embodiments does not define or constrain the disclosure. Other changes, substitutions, and alterations are also possible without departing from the spirit and scope of this disclosure, and such changes, substitutions, and alterations may be included within the scope of the disclosure and the claims.

What is claimed is:

1. A scope comprising:

a tube;

an objective system;

an ocular system; and an erector system comprising an adjustment mechanism connected to the tube such that the adjustment mechanism provides movement of a reticle on an image that is created by the objective system, the adjustment mechanism comprising a saddle mechanism, a turret cap mechanism, and a quick release mechanism, wherein the quick release mechanism comprises a threaded bolt, a lever, and a pressure plate, wherein the pressure plate resides between the threaded bolt and the lever, and wherein the lever is hingedly attached to the bolt.

2. The scope of claim 1, where the pressure plate is adjacent to the turret cap mechanism and applies pressure to the turret cap mechanism when the quick release mechanism is in the locked position.

3. The scope of claim 1, wherein the quick release mechanism is connected to the saddle mechanism.

4. The scope of claim 1, where the quick release mechanism further comprises a cam lock with an eccentric cam and an axle that locks the turret cap assembly such that the saddle assembly rotates when the cam lock is in a locked position and the turret cap is rotated.

5. The scope of claim 4, wherein the quick release mechanism can be unlocked using the lever.

6. The scope of claim 5, where the lever comprises a coin.

7. The scope of claim 5, where the lever comprises a rim of a cartridge.

8. The scope of claim 1, where the adjustment mechanism further comprises a tactile and/or audible click mechanism;

wherein the tactile and/or audible click mechanism comprises a first and a second plurality of click values corresponding to a predetermined shift in a position of a reticle of the scope; and wherein the first plurality of click values has a different tactile response and/or audible response than the second plurality of click values.

9. The scope of claim 8, wherein the click mechanism further comprises:

a click ring having a first plurality of detents and a second plurality of detents with the first and second pluralities of detents corresponding to different tactile responses and/or audible responses; and a click element engaging said detents.

10. The scope of claim 9, where the detents are grooves or ridges.

11. The scope of claim 9 further comprising at least two click rings wherein the first plurality of detents are on a different click ring from the second plurality of detents.

12. The scope of claim 11 further comprising at least two click elements wherein each click element engages a different click ring.

13. The scope of claim 9, where the click element comprises a detent ball.

14. The scope of claim 9, where the click element comprises a roughly wedge-shaped element designed to engage the detents of the click ring.

15. The scope of claim 9, where a single click element engages more than one click ring.

16. The scope of claim 1, where the turret cap mechanism is easily removable and replaceable by a second turret cap mechanism.

17. The scope of claim 16, where the turret cap mechanism has a different click value than the second turret cap mechanism.

18. The scope of claim 16, where the turret cap mechanism can be removed without tools.

19. The scope turret mechanism of claim 1, wherein the quick release mechanism further comprises a manually manipulatable component.

* * * * *